US007337989B1

(12) United States Patent
Penner et al.

(10) Patent No.: US 7,337,989 B1
(45) Date of Patent: Mar. 4, 2008

(54) AUTOMATED SPRAYER WITH MANUALLY-ADJUSTABLE NOZZLE

(75) Inventors: Thomas A. Penner, Racine, WI (US); Brenten T. Nauslar, Shorewood, WI (US); Cathal L. Fahy, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 11/691,035

(22) Filed: Mar. 26, 2007

(51) Int. Cl.

| | |
|---|---|
| ***B05B 3/00*** | (2006.01) |
| ***B05B 3/02*** | (2006.01) |
| ***B05B 15/06*** | (2006.01) |
| ***B05B 15/08*** | (2006.01) |
| ***B05B 13/00*** | (2006.01) |

(52) U.S. Cl. ..... 239/263.1; 239/210; 239/225.1; 239/247; 239/282; 239/329; 239/587.1; 239/587.5

(58) Field of Classification Search ..... 239/263.1, 239/210, 225.1, 247, 282, 329, 587.1, 587.5, 239/67, 70, 227, 273, 283, 302, 309, 332, 239/587.2, 587.3, 587.4, 588; 222/52, 63, 222/80, 83, 180, 181.1, 181.3, 185.1, 639
See application file for complete search history.

(56) References Cited

U.S. PATENT DOCUMENTS

| | | | | |
|---|---|---|---|---|
| 2,858,836 | A | 11/1958 | Geh et al. | |
| 2,992,781 | A | 7/1961 | Howard, Sr. | |
| 3,563,464 | A | 2/1971 | Doornnbos et al. | |
| 3,994,310 | A | 11/1976 | Brandon | |
| 4,596,362 | A | 6/1986 | Pralle et al. | |
| 5,248,094 | A | 9/1993 | Munoz | |
| 5,316,218 | A | 5/1994 | Bowen | |
| 5,377,913 | A * | 1/1995 | Van Der Woude | 239/227 |
| 5,536,200 | A | 7/1996 | Kiess | |
| 5,865,374 | A | 2/1999 | Barta et al. | |
| 5,971,301 | A | 10/1999 | Stouffer et al. | |
| 5,992,301 | A | 11/1999 | Mukumoto | |
| 5,992,404 | A | 11/1999 | Bleyer et al. | |
| 6,230,091 | B1 | 5/2001 | McQuinn | |
| 6,322,008 | B1 | 11/2001 | Aker et al. | |
| 6,328,543 | B1 * | 12/2001 | Benecke | 417/411 |
| 6,729,559 | B2 | 5/2004 | Zanma et al. | |
| 6,820,821 | B2 | 11/2004 | Linstedt et al. | |
| 7,021,499 | B2 | 4/2006 | Hansen et al. | |
| 7,111,800 | B2 | 9/2006 | Berning et al. | |
| 7,152,808 | B2 | 12/2006 | Jenkins | |
| 2004/0050959 | A1 | 3/2004 | Mazooji et al. | |
| 2004/0217197 | A1 * | 11/2004 | Mazooji et al. | 239/302 |
| 2005/0127204 | A1 * | 6/2005 | Linstedt et al. | 239/222.11 |

FOREIGN PATENT DOCUMENTS

| | | | |
|---|---|---|---|
| EP | 1191166 | A1 | 3/2002 |
| JP | 10-328059 | * | 12/1998 |
| WO | WO/96/22346 | | 7/1996 |
| WO | WO/98/02511 | | 1/1998 |

* cited by examiner

*Primary Examiner*—Darren Gorman

(57) ABSTRACT

An automated sprayer for spraying walls of a shower or bathing enclosure with a liquid cleanser. A spray head rotates on an essentially vertical axis. Its outlet nozzle pivots on an essentially horizontal axis (but not otherwise) to adjust the vertical angle of the spray, thereby rendering the device adjustable for different size enclosures, and for treating problem stains.

5 Claims, 5 Drawing Sheets

AUTOMATED SPRAYER WITH MANUALLY-ADJUSTABLE NOZZLE

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This invention relates to sprayers that are designed to automatically clean shower/bathing enclosures (especially those in residential buildings). More particularly, it relates to rotating sprayers having a nozzle which permits the verticality of the spray direction to be adjusted to account for different size enclosures and hard to clean localized stains.

The walls/doors of shower enclosures can become mildewed, coated with soap build up, hard water and/or mineral deposits, or become otherwise soiled, during typical use. Removing these deposits and stains has in the past required one to scrub the walls and doors by hand, particularly if significant amounts of time have passed between cleanings.

To assist in this task, cleaning chemicals have been sprayed, squirted, or otherwise applied on the surfaces to be cleaned. The walls are then scrubbed with a cloth, brush, or scrubbing pad, and then rinsed with water.

More recently some of these cleaners have been designed so that the amount of scrubbing can be reduced or even eliminated without compromising cleaning, particularly where the cleaners are sprayed on a daily basis. See generally, WO 96/22346 and WO 98/02511. These cleaners are designed so as not to themselves leave spots or other visible stains, even if not rinsed off for hours or days after application.

"No scrub" cleaners are preferably applied after the shower has been used. This is accomplished by a consumer keeping a pump spray bottle of the cleanser in or near the shower enclosure, remembering to do the spraying (which may be problematic if the consumer has just woken up), and being willing (or able) to spend the time necessary to spray the enclosure.

An alternative no scrub approach is to provide an automated sprayer device for a shower. For example, U.S. patent application publication 2004/0050959 discloses an automated cleansing sprayer that uses an internal pump to spray cleaning fluid from a reservoir out from a rotating nozzle against enclosure walls. One presses an activation button, leaves the shower, and lets the device run through a spraying cycle. There is no need for scrubbing the enclosure walls, or rinsing off the cleaning liquid.

However, not all enclosures are of the same size. For example, some shower enclosures are essentially square in top view and relatively small. Some bathing enclosures are elongated rectangular in top view and much larger. A rotating nozzle configured to clean a small shower may not direct cleaning liquid to all of the desired portions of a larger bathing enclosure.

To address that concern, one might use multiple nozzle holes to spread the spray more widely, or configure the device at a compromise setting half-way between optimized settings for the largest and smallest expected enclosures.

However, either such approach might require extra cleaning liquid to achieve the desired cleaning.

Further, where such devices are first installed after an enclosure has already become heavily stained in a localized manner, there is a desire to use extra cleaner on the most stained area. However, such devices are designed to spray in a more uniform manner as a general rule. This may lead a consumer to use extra cycles of the device to achieve cleaning, and/or a consumer becoming dissatisfied with the cleaning performance.

In unrelated work U.S. Pat. Nos. 5,992,404, 5,536,200 and 5,248,094 showed various structures for pointing nozzles. However, these systems were not easily adaptable to the present environment. For example, the use of a universal nozzle joint in the context of the present device would be unsuitable as rotational forces would be likely to drive the nozzle out of the selected position.

Hence, a need still exists for improved automated shower cleaners, particularly with respect to capability of adjusting for different size enclosures and providing for localized stain treatment capability.

SUMMARY OF THE INVENTION

In one aspect the invention provides an automated sprayer for spraying an enclosure with a liquid cleanser. There is a spray head having an outlet through which cleanser can be expelled during operation of the sprayer (if the sprayer is linked to a supply of such liquid cleanser). There is also a nozzle positioned on the outlet, and a motor for rotating the spray head (preferably around an essentially vertical axis).

The vertical position of the nozzle is capable of being manually adjusted to adjust where the liquid cleanser is directed by the sprayer. For example, the nozzle may be capable of being manually pivoted relative to the spray head to adjust an angle at which the liquid cleanser is directed during operation of the sprayer (when the sprayer is linked to a supply of such liquid cleanser). The nozzle connection is sufficiently stable so that mere rotation of the spray head won't dislodge the angle.

In some preferred forms the outlet is linked to a first tube, and the nozzle is in the form of a second tube linked to the first tube along an essentially horizontal pivot axis. Most preferably the nozzle is not capable of being universally pivoted relative to the first tube, or capable of being pivoted in a direction of rotation of the spray head.

The nozzle can be manually pivoted relative to the spray head to adjust the angle at which the liquid cleanser is directed during operation by up to at least 90 degrees, preferably by up to at least 120 degrees, even more preferably by up to at least 160 degrees, most preferably by about 180 degrees.

In an alternative form the nozzle has a nipple attached directly to the outlet. Here the pivoting of the nipple is enabled within the spray head, preferably by a joint upstream of the outlet.

Alternatively, the nozzle's vertical position could be manually adjusted by other means. For example, the entire turret could be linked by a ratchet or other connection permitting it to be pushed towards or away from the main sprayer body, while still permitting it to rotate.

Note that by "manual" we are preferring something that can be achieved without the use of tools to make the adjustment, but are not excluding the possibility of an adjustment system that can use a screw driver or other manual tool to facilitate the adjustment.

For small enclosures the nozzle won't usually be positioned/pointed as much upward as for larger ones (absent a localized stain to be cleaned). In this regard, for larger enclosures one typically wants a more vertical spray direction so as to be able to provide adequate spray at even the upper parts of the farthest away walls. A consumer that wants to install such a device in their enclosure would assess generally its dimensions, take into account the location of the best mounting position (e.g. the shower outlet pipe), and then angle the nozzle to optimize spraying (likely taking into account package recommendations).

If a consumer instead wants to begin use of the sprayer on an enclosure already heavily stained at localized positions, and wants to direct extra cleaning effort at those positions, the initial directional and vertical position setting can take that into account. Then, when that stain is adequately addressed, the setting can be optimized for a more uniform treatment optimized for that enclosure.

These adjustability advantages can be achieved at low additional cost. Further, this type of adjustment mechanism can even be retrofit on certain existing devices of this type.

These and other advantages of the invention will be apparent from the detailed description which follows and the drawings. It should be appreciated that what follows is merely a description of preferred embodiments. That description is not meant as a limitation of the full scope of the claims. Rather, the claims should be looked to in order to judge the full scope of the invention.

DETAILED DESCRIPTION OF THE PREFERRED EMBODIMENTS

Figure 1:
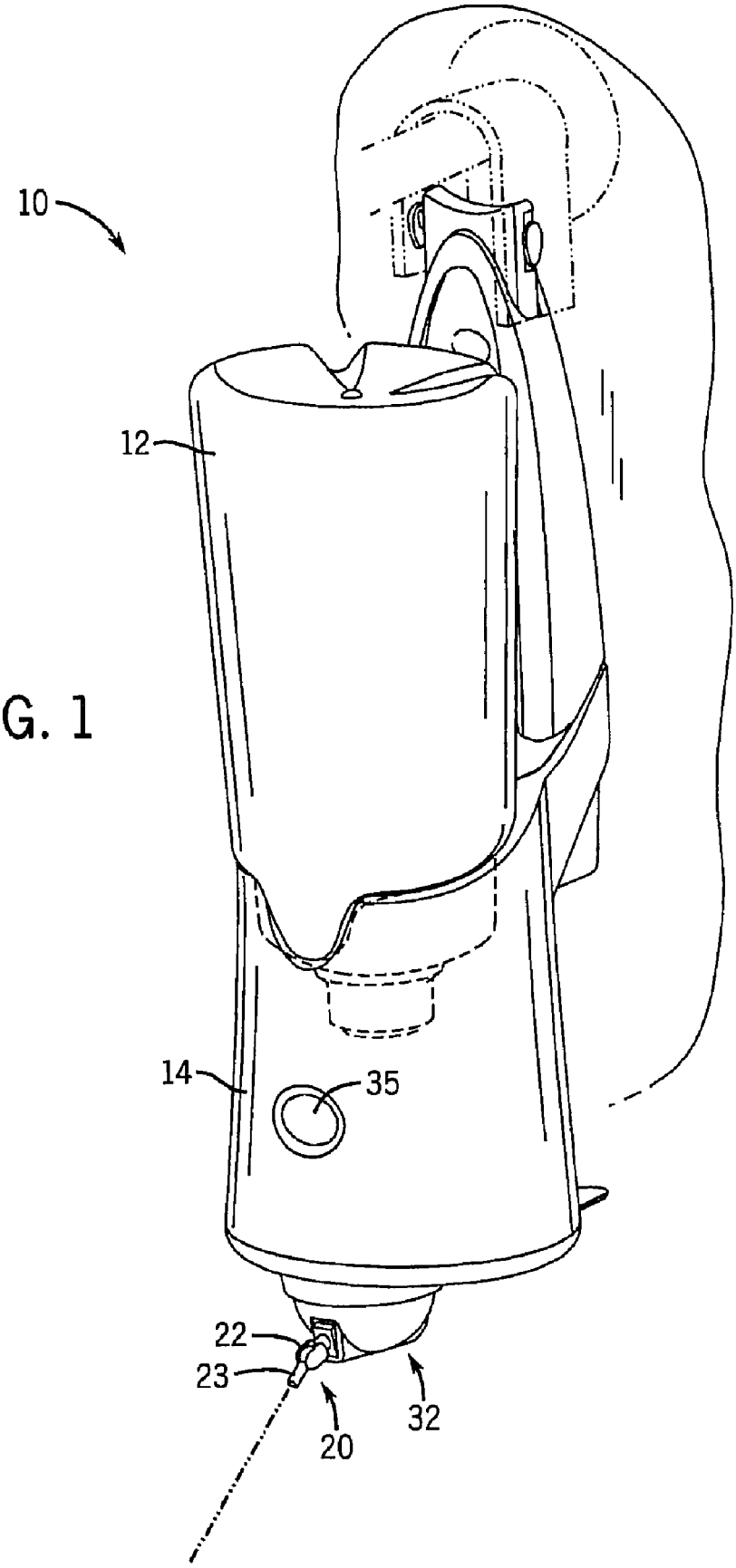
FIG. 1 is a perspective view of a preferred embodiment of an automated sprayer of the present invention.
Figure 2:
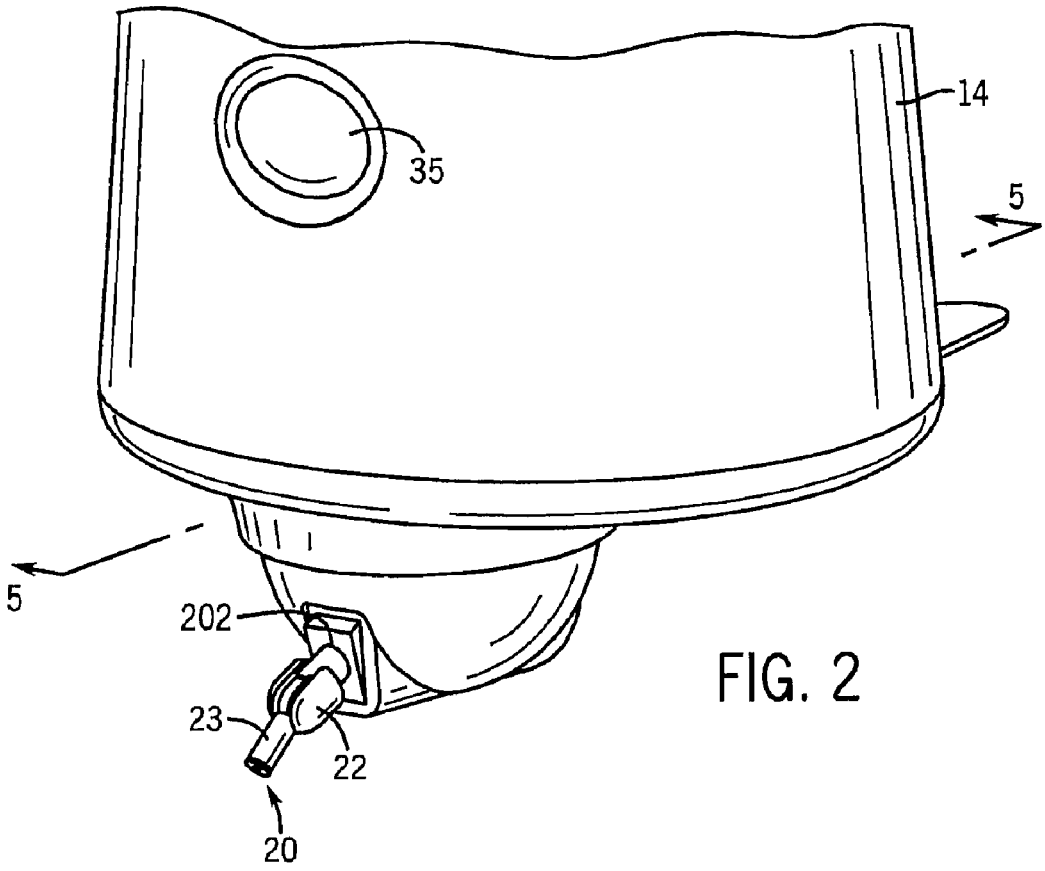
FIG. 2 is an enlarged perspective view of the lower portion of the sprayer focusing on a manually-adjustable nozzle.

The sprayer 10 includes a bottle 12 containing a supply of cleaning liquid, a housing 14 with an adjustable hanger 26, and a rotatable spray head 32 having a manually-adjustable nozzle 20. Alternatively, a fixed wire hanger may be used for mounting purposes.

Figure 3:
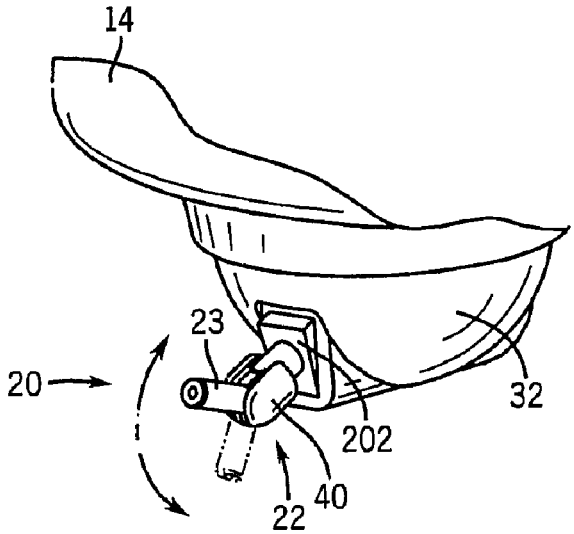
FIG. 3 is another perspective view of the manually-adjustable nozzle, with altered orientation.

Apart from the portion shown in FIG. 3 the device is essentially based on devices of the type depicted in U.S. patent application publication 2004/0050959, which is incorporated by reference as if fully set forth herein. These devices are provided with an internal replaceable battery that provides power to a motor. The motor drives both a pump and a rotating drive for the spray head.

The pump delivers cleaning liquid from the bottle 12 to the spray head 32. The sprayer 10 is typically suspended from a shower pipe or the like. Thus, it does not require room electrical power, or a connection to the room water supply.

Once activated by pressing button 35, an internal computer controller delays a spraying cycle for a short period, allowing the consumer to exit the shower. The spray cycle then begins and ends automatically (e.g. one minute of rotational spraying). The cycle is preferably initiated immediately after a consumer finishes a shower and is about to leave the shower. Hence, there is no rinsing in a typical application, at least not until the next time the shower is normally used.

Figure 5:
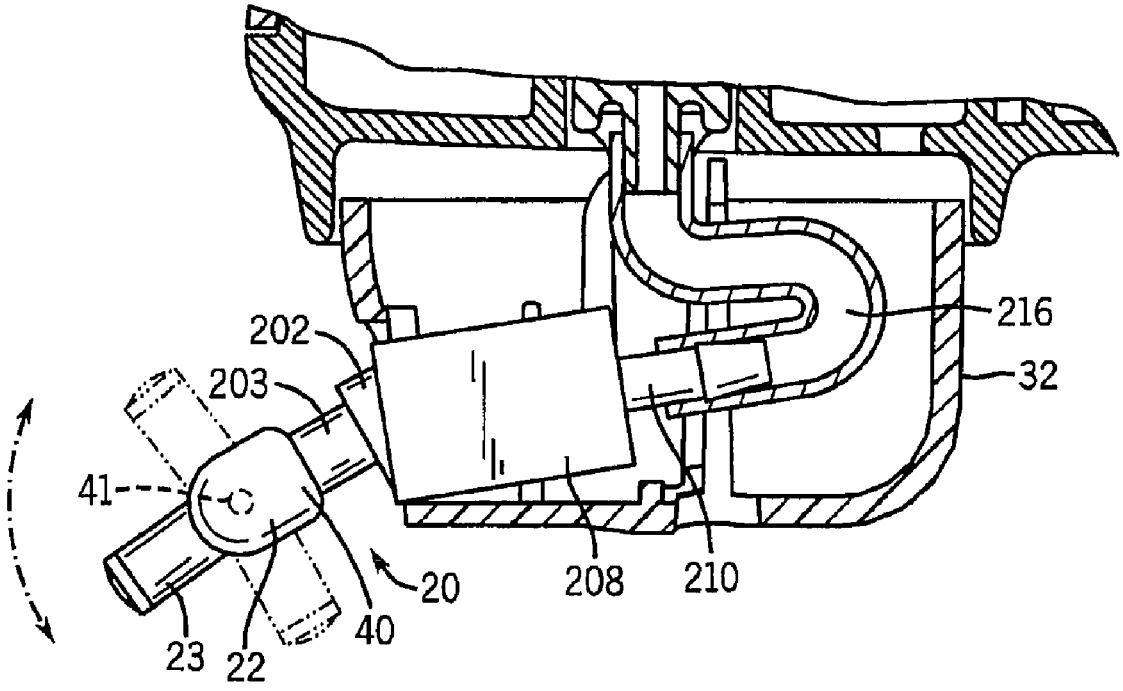
FIG. 5 is a cross-sectional view taken along line 5-5 of FIG. 2.
Figure 6:
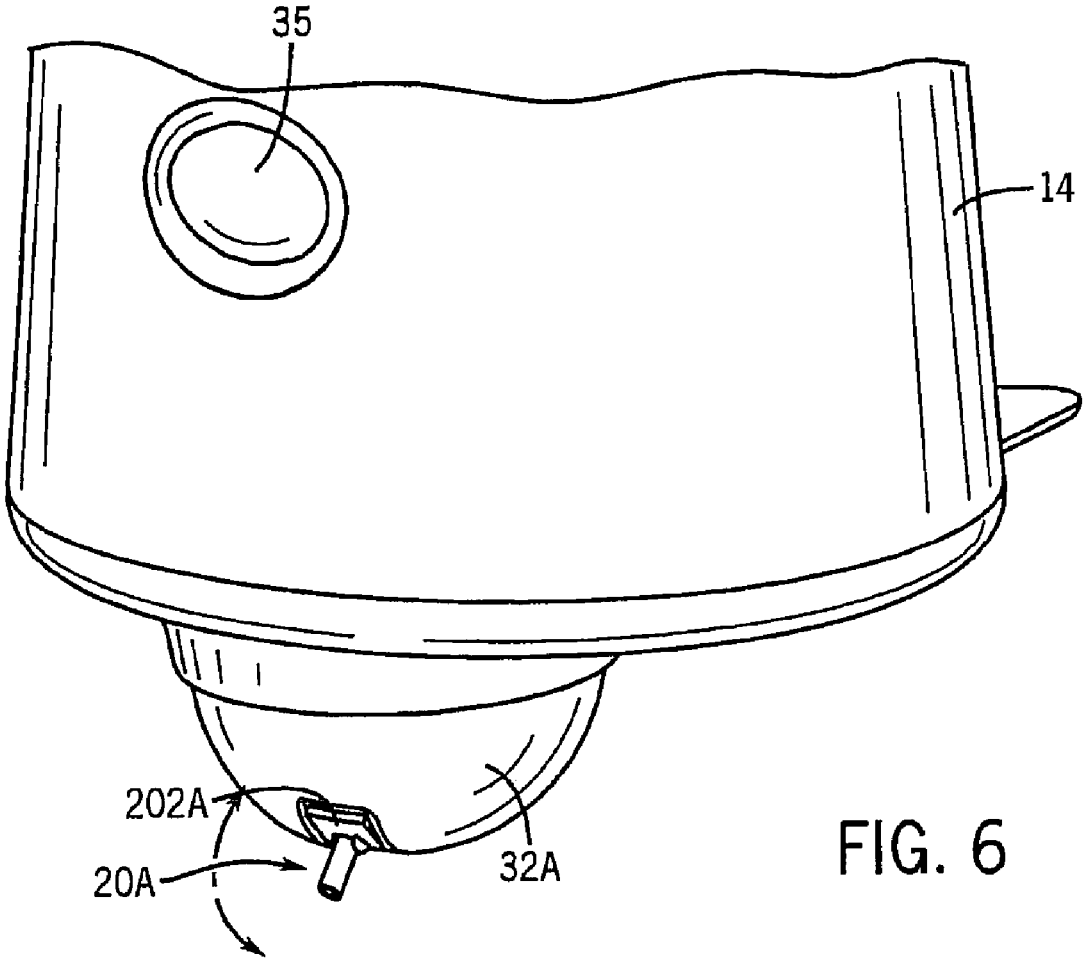
FIG. 6 is a perspective view of an alternate embodiment.

As shown in FIG. 5 an outlet 202 is provided on the rotatable spray head 32. Upstream of outlet 202 may be positioned a fluidic pulsing device with a housing 208, an inlet 210 and a feed tube 216 leading from a pump (not shown).

The outlet 202 is connected to a first tube 203 which then connects to nozzle 20. Nozzle 20 comprises a turret 22 having side arms 40 holding an axle 41 that pins a second tube/nipple 23. The axle 41 may be short projections from each side of tube 23 that snap into accommodating recesses on the arms 40. Alternatively, it may be a through axle that passes through the arms and the tube 23.

In any event, the idea is to allow the second tube 23 to pivot relative to the first tube 203 between the arms 40. This can be achieved without losing fluid communication because the inner termini of the tubes 23/203 can both lead into an enlarged pocket defined between arms 40, with the termini spaced enough from each other to allow the pivoting.

The arms 40 can frictionally engage the second tube 23 to permit the desired angle adjustment, but still resist unintended adjustment due to gravity or rotational forces. If desired, ratchet structures can be provided between the internal surfaces of the arms 40 and corresponding projections can be provided on second tube 23 to interact with those ratchet structures, to further insure desired angular settings.

Figure 4:
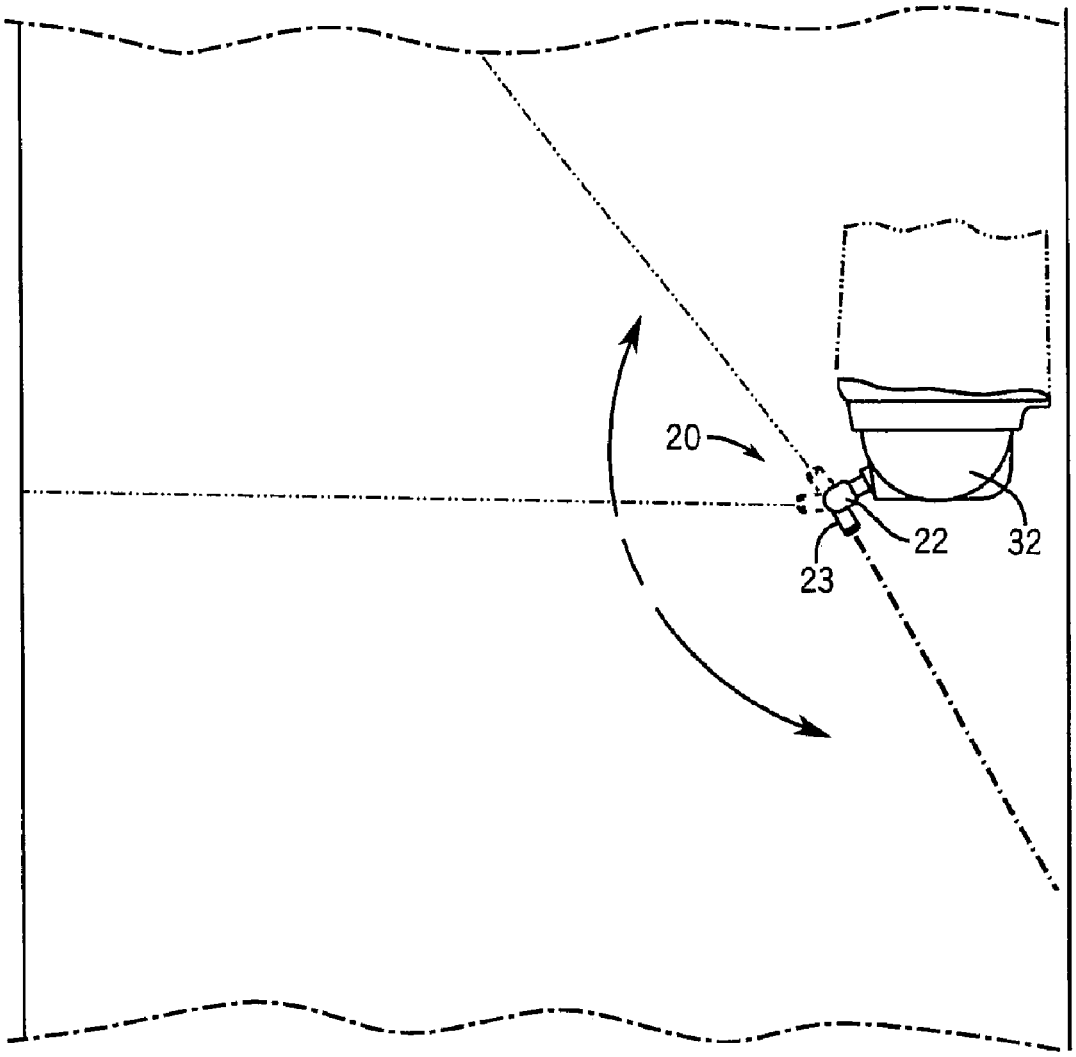
FIG. 4 is a partial, largely schematic, side view of that sprayer.

The sprayer 10 may be hung so that its outlet 202 extends downwardly at approximately a 30 degree angle. As seen in FIG. 4, the second tube/nipple 23 is adjustable along about a 180 degree range extending there from. This permits a spray that can arc across to a far away wall, as well as permit the wall from which the shower head is mounted to be adequately cleaned if it has a localized stain.

Most preferably, the arms 40 provide a vertical slot that inhibits undesired angling of the nozzle 23 in the direction that the spray head rotates. The arms thus resist rotational forces.

In an alternate embodiment, as seen in FIG. 7, similar parts are designated with similar numbers, albeit with a designation A as well. For this embodiment, the main difference is that angular adjustment occurs at a joint mostly within spray head 32A, such as by a joint upstream of outlet 202.

In a further embodiment, rather than making the adjustment by a pivoting, one could have the turret 22 mounted so that it is vertically adjustable as a whole within the supporting structure 202 and suitable to be fixed at specified vertical positions. That would achieve some manual adjustment, albeit derived from verticality alone, rather than angular direction.

In yet another embodiment, both the pivotal adjustment and the vertical adjustment of the prior paragraph could be incorporated. This could provide greater flexibility. For example, in a small enclosure with a lower stain one might want to direct the nozzle down without raising the turret. In a large enclosure with a lower stain one might want to direct the nozzle down while also raising the turret.

Preferred embodiments of the invention have been described above. However, modifications and variations to the preferred embodiments will be apparent to those skilled in the art from this disclosure, which will be within the spirit and scope of the invention.

Therefore, the invention should not be limited to just the described embodiments. To ascertain the full scope of the invention, reference should be made to the following claims.

INDUSTRIAL APPLICABILITY

The invention provides a sprayer for automatically spraying the walls of shower enclosures or the like, where the sprayer can be optimized for use with different size enclosures.

We claim:

1. An automated sprayer for spraying an enclosure with a liquid cleanser, comprising:

a spray head having an outlet through which cleanser can be expelled during operation of the sprayer, if the sprayer is linked to a supply of such liquid cleanser;

a nozzle positioned on the outlet; and a motor for rotating the spray head;

a hanger for mounting the sprayer to the enclosure;

wherein the vertical position of the nozzle is capable of being manually adjusted to adjust how the liquid cleanser is directed by the sprayer;

wherein the nozzle is capable of being manually pivoted relative to the spray head apart from rotation of the spray head to adjust an angle at which the liquid cleanser is directed; and wherein the spray head is rotatable about an essentially vertical axis and the nozzle is capable of being pivoted relative to the spray head to adjust an angle at which the liquid cleanser is directed during operation by up to at least 160 degrees and is capable of being pointed at least somewhat upwardly when the spray head is rotating about said vertical axis.

2. An automated sprayer for spraying an enclosure with a liquid cleanser, comprising:

a spray head having an outlet through which cleanser can be expelled during operation of the sprayer, if the sprayer is linked to a supply of such liquid cleanser;

a nozzle positioned on the outlet; and a motor for rotating the spray head;

wherein the vertical position of the nozzle is capable of being manually adjusted to adjust how the liquid cleanser is directed by the sprayer;

wherein the nozzle is capable of being manually pivoted relative to the spray head to adjust an angle at which the liquid cleanser is directed;

wherein the outlet is linked to a first tube and the nozzle is in a form of a second tube pivotably linked to the first tube along an essentially horizontal pivot axis.

3. The automated sprayer of claim 2, wherein the nozzle is not capable of being universally pivoted relative to the first tube.

4. The automated sprayer of claim 2, wherein the nozzle is not capable of being angled in a direction of rotation of the spray head.

5. The automated sprayer of claim 1, wherein the nozzle forms a part of a turret which is manually vertically adjustable.

* * * * *